US005330037A

United States Patent [19]

Wang

[11] Patent Number: 5,330,037

[45] Date of Patent: Jul. 19, 1994

[54] WHEELED TRAVEL BAG WITH ADJUSTABLE HANDLE

[76] Inventor: King-Shen Wang, No. 16, Lane 116, Ta An Kang Rd., Ta Chia Chen, Taichung Hsien, Taiwan

[21] Appl. No.: 945,251

[22] Filed: Sep. 15, 1992

[51] Int. Cl.[5] ..... A45C 5/14; A45C 13/26

[52] U.S. Cl. ..... 190/18 A; 190/39; 190/115; 280/37

[58] Field of Search ..... 190/115, 18 A, 18 R, 190/39; 280/37

[56] References Cited

U.S. PATENT DOCUMENTS

| | | | |
|---|---|---|---|
| 381,646 | 4/1888 | Rivers | 190/39 |
| 959,235 | 5/1910 | Lemieux | 190/39 |
| 2,002,836 | 5/1935 | Rossi | 190/18 A X |
| 2,784,816 | 3/1957 | Goldberg | 190/115 |
| 3,257,120 | 6/1966 | Browning | 190/18 A X |
| 3,522,955 | 8/1970 | Warner, Jr. | 190/18 A X |
| 4,256,320 | 3/1981 | Hager | 190/18 A X |
| 4,261,077 | 4/1981 | Brock et al. | 190/39 X |
| 4,358,005 | 11/1982 | Fontana | 190/18 A |
| 4,550,813 | 11/1985 | Browning | 190/18 A |
| 4,759,431 | 7/1988 | King et al. | 190/18 A |
| 5,048,649 | 9/1991 | Carpenter et al. | 190/18 A |
| 5,197,579 | 5/1993 | Bieber et al. | 190/115 X |

FOREIGN PATENT DOCUMENTS

| | | | |
|---|---|---|---|
| 487220 | 11/1953 | Italy | 190/18 A |
| 9111126 | 8/1991 | PCT Int'l Appl. | 190/18 A |
| 117843 | 12/1946 | Sweden | 190/115 |
| 2111465 | 7/1983 | United Kingdom | 190/115 |

*Primary Examiner*—Sue A. Weaver

*Attorney, Agent, or Firm*—Bacon & Thomas

[57] ABSTRACT

A travel bag having a handle assembly consisting of an elongated handle bar movably inserted in a channel plate for carrying, and a U-shaped auxiliary handle pivoted to the channel plate for lifting. The travel bag also has a fixed castor on a curved bottom thereof in the middle, a first pair of opposite swivel castors on one end of the bottom edge, and a second pair of opposite swivel castors on an opposite end of the bottom edge. The fixed castor and either pair of opposite swivel castors are in contact with the ground as the luggage is moved.

11 Claims, 6 Drawing Sheets

WHEELED TRAVEL BAG WITH ADJUSTABLE HANDLE

BACKGROUND OF THE INVENTION

The present invention relates to a travel bag and, more particularly, to the improvement of a handle assembly and the arrangement of castors for the travel bag.

A travel bag for containing a traveler's belongings generally has castors on the bottom for moving and a handle for carrying by hand. Because the handle is commonly not adjustable and the castors are respectively arranged on the four corners of the bottom edge, it is too great an effort for a traveler to carry the travel bag.

SUMMARY OF THE INVENTION

The present invention is to provide a travel bag which can be conveniently moved on the ground and turned in another direction with reduced effort. According to one aspect of the present invention, the travel bag has an adjustable handle assembly comprising an elongated handle bar movably inserted into a channel sleeve. According to another aspect of the present invention, the sleeve has two opposite stub rods on the inside adjacent to a top opening thereof, which are inserted into two opposite longitudinal grooves on the elongated handle bar. Therefore, the elongated handle bar can be rotated on the stub rods and adjusted to the desired angular position when it is drawn out of the sleeve. According to still another aspect of the present invention, the elongated handle bar has a toothed bottom end for positioning the handle bar at the desired angular orientation relative to the sleeve. According to still another aspect of the present invention, the luggage has a fixed castor on a bottom edge thereof in the middle, a first pair of opposite swivel castors on one end of the bottom edge, and a second pair of opposite swivel castors on an opposite end of bottom edge, wherein the fixed castor and either pair of opposite swivel castors are in contact with the ground as the luggage is moved.

DETAILED DESCRIPTION OF THE PREFERRED EMBODIMENT

Figure 1:
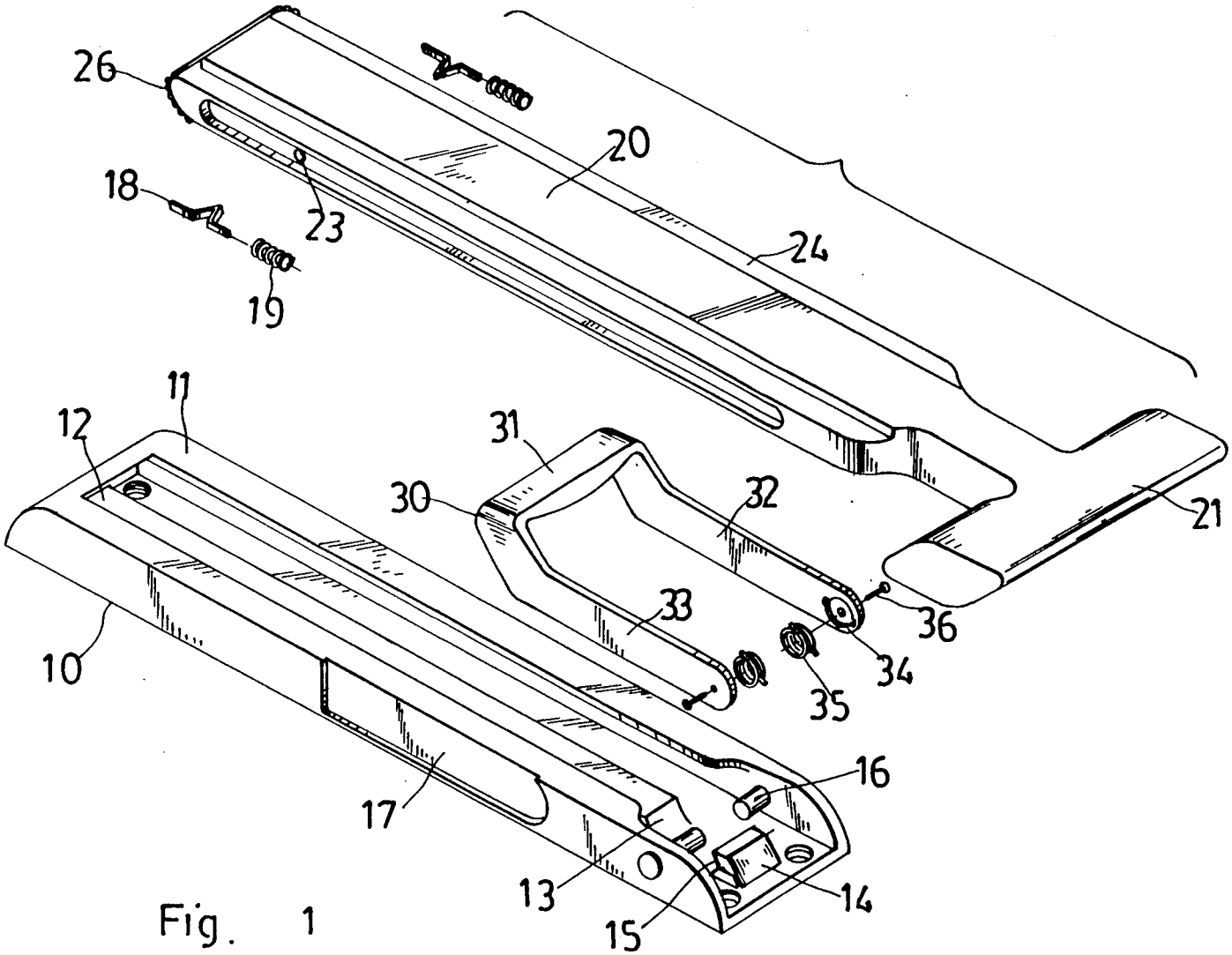
FIG. 1 is an exploded perspective view of a handle assembly according to the present invention.
Figure 1A:
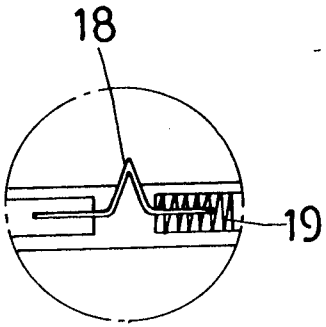
FIG. 1A is a plan view in an enlarged scale showing a leaf spring retained by a spring.

Referring to FIG. 1, therein illustrated is a handle assembly for a travel bag according to the present invention which is generally comprised of a sleeve 10, an elongated handle bar 20, and an auxiliary handle 30. The sleeve 10 is made in a substantially rectangular shape having: an elongated channel 11 through a large, longitudinal top face thereof; a longitudinal rail 12 raised from an inside surface thereof below the elongated channel 11 which terminates in a curved front edge 13; a resilient projecting block 14 raised from the inside surface in front of the curved front edge 13 of the longitudinal rail 12 adjacent to a front opening thereof; two inward stub rods 16 transversely disposed between the curved front edge 13 of the longitudinal rail 12 and the resilient projecting block 14 at opposite locations; two leaf springs 18 retained on the inside by springs 19 at two opposite locations (see FIG. 1A); and two recessed surface portions 17 on opposite, longitudinal side walls thereof, wherein the resilient projecting block 14 has a curved back edge 15 facing the curved front edge 13 of the longitudinal rail 12. The elongated handle bar 20 has: a top end formed into a transverse handhold portion 21; a bottom end formed into a toothed portion 26 having a series of parallel teeth; a flat projecting wall 24 raised from a large, longitudinal top face thereof which fits into the channel 11 on the sleeve 10; a longitudinal bottom groove 25 (see FIG. 2) formed on a large, longitudinal bottom face thereof; and two longitudinal side grooves 22 on opposite, longitudinal side walls thereof, wherein each side groove 22 has a hole 23 at a suitable location—which leaf spring 18 may engage. The auxiliary handle 30 is made from a substantially U-shaped frame comprising a transverse handhold portion 31 connected between two spaced legs 32, 33 at one end thereof. The legs 32, 33 of the auxiliary handle 30 each have a spring seat 34 on a respective inner side to hold a respective torsion spring 35. The assembly process of the handle assembly is quite simple. As the handle bar 20 is inserted into the sleeve 10, the flat projecting wall 24 of the handle bar 20 fits into the channel 11 on the sleeve 10, the longitudinal rail 12 of the sleeve 10 fits into the elongated groove 25, and the two opposite stub rods 16 of the sleeve 10 respectively engage the longitudinal side grooves 22 on the handle bar 20. Two legs 32, 33 of the auxiliary handle 30 are respectively pivoted to the recessed surface portions 17 on the sleeve 10 by screws 36. When assembled, the transverse handhold portion 21 is located externally of the sleeve 10, since the length of the transverse handhold portion 21 is relatively longer than the width of the sleeve 10. The handle bar 20 can be drawn out of the sleeve 10 then pushed back into place.

Figures 2, 2A:
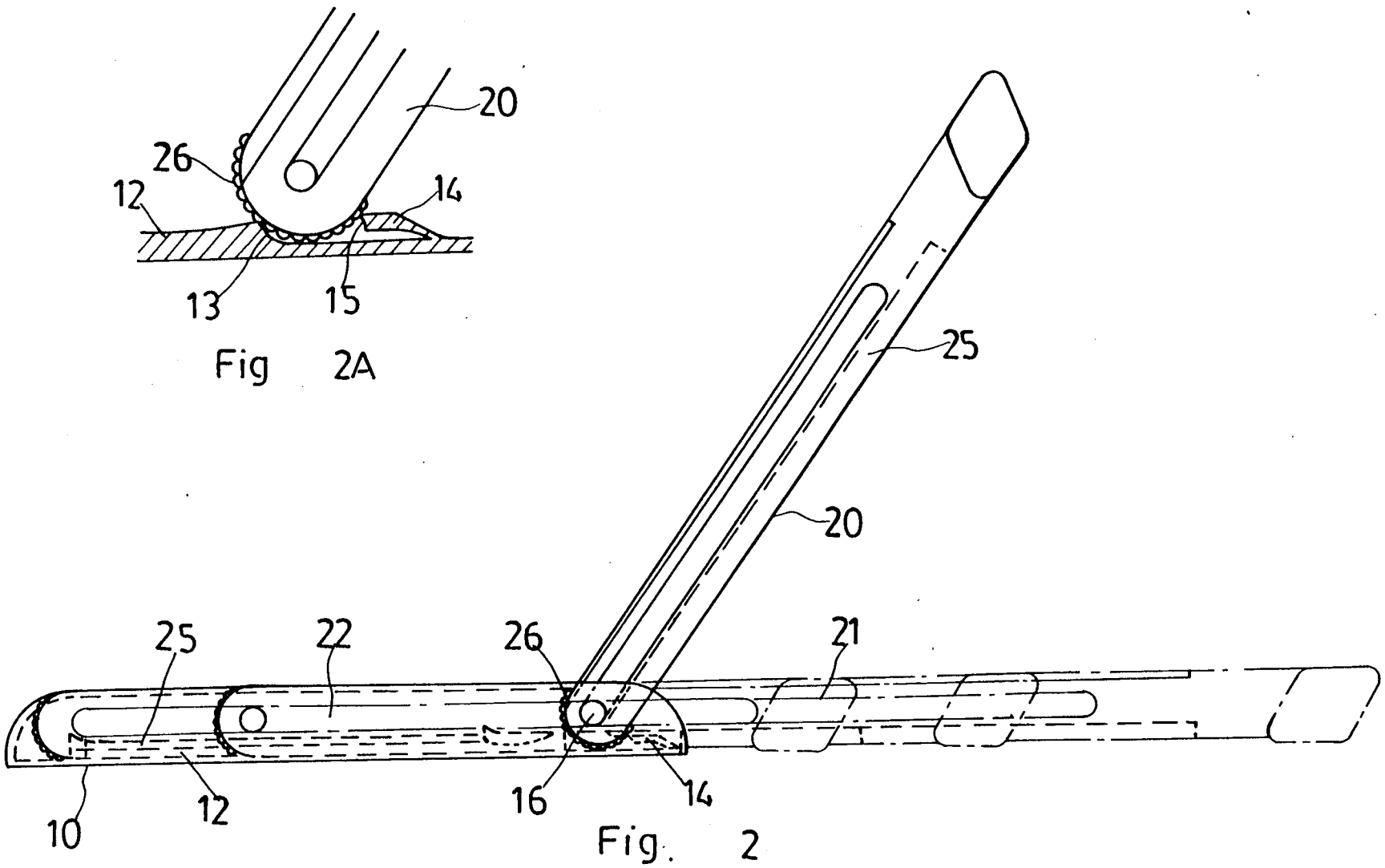
FIG. 2 is a side view showing the movement of the elongated handle of the handle assembly of FIG. 1 relative to the sleeve.
FIG. 2A is an enlarged side view illustrating the toothed portion of the elongated handle bar engaged with the curved front edge of the longitudinal rail and the curved back edge of the resilient projecting block of the sleeve.

Referring to FIGS. 2 and 2A, as the handle bar 20 is drawn out of the sleeve 10, it is retained to the sleeve 10 by the two opposite stub rods 16. When withdrawn fully, the handle bar 20 can be rotated on the stub rods 16 to change its angular position relative to the sleeve 10 (see FIG. 2). As soon as the handle bar 20 has been properly adjusted to the desired angular position relative to the sleeve 10, it is firmly retained in this position by engagement of the toothed portion 26 with the curved front edge 13 of the longitudinal rail 12 and the curved back edge 15 of the resilient projecting block 14 (see FIG. 2A). The handle bar 20 can be conveniently collapsed and returned back inside the sleeve 10 by depressing downwardly (as viewed in FIG. 2A) the resilient projecting block 14 to disengage the curved back edge 15 from the toothed portion 26.

Figure 4:
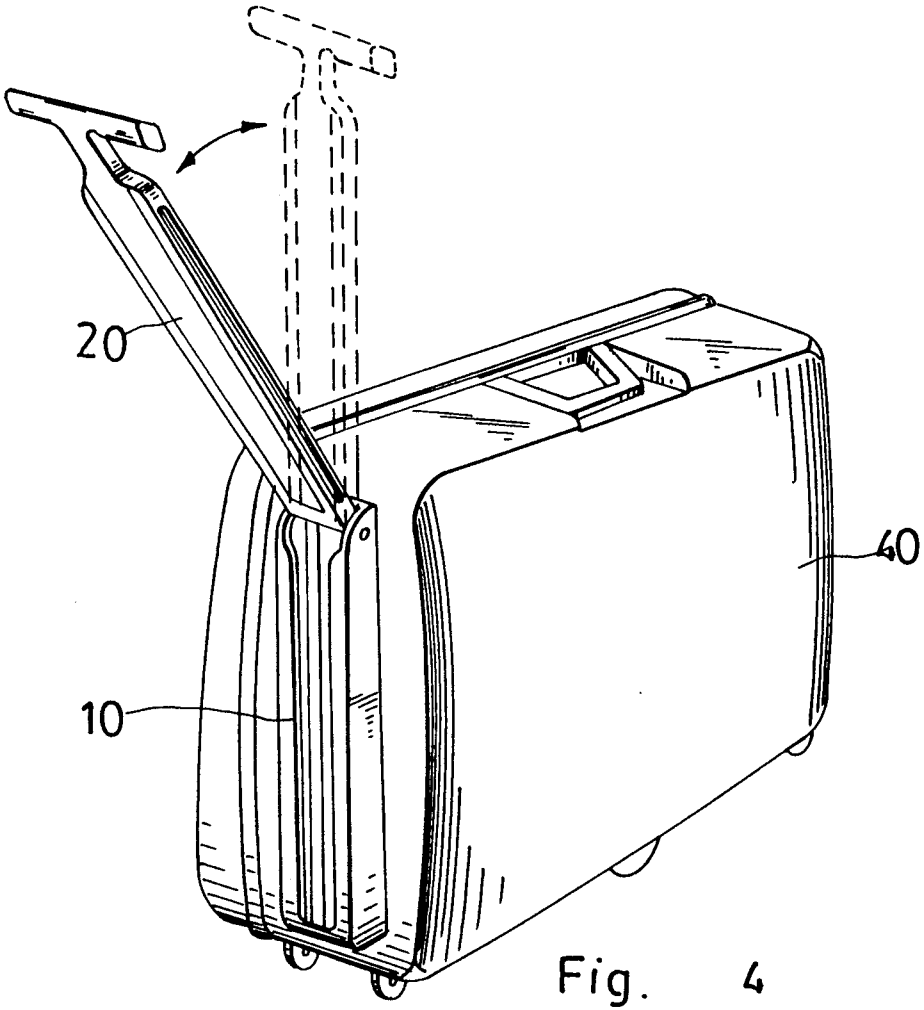
FIG. 4 is a perspective view showing the elongated handle bar drawn out of the sleeve and adjusted to an oblique position relative to the sleeve.
Figure 3:
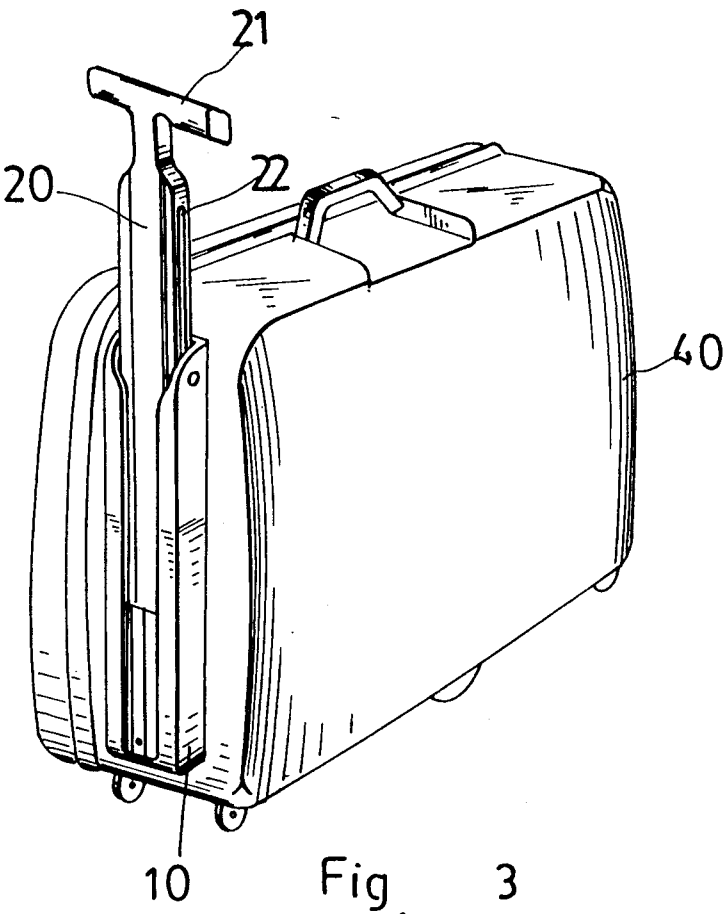
FIG. 3 is a perspective view illustrating the handle assembly fastened to one lateral side of the travel bag with the elongated handle bar drawn halfway out of the sleeve.

Referring to FIGS. 3 and 4, therein illustrated is a travel bag 40 having a handle assembly according to the present invention. As illustrated in FIG. 3, the handle bar 20 is half drawn out of the sleeve 10 and is retained in place by the leaf spring 18. As illustrated in FIG. 4, the handle bar 20 is fully drawn out of the sleeve 10 and rotated on the stub rods 16 to the desired angular position.

Figure 5:
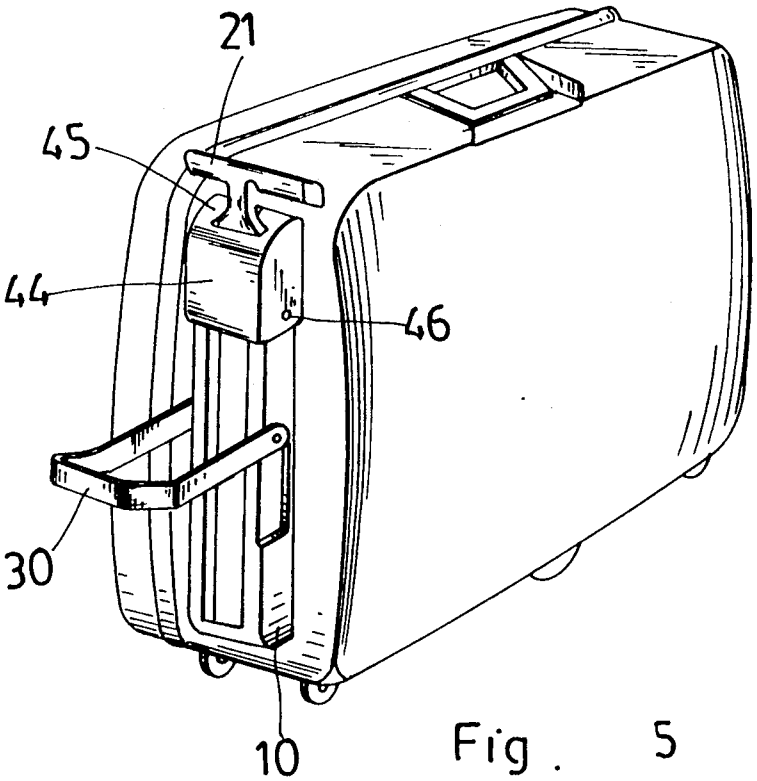
FIG. 5 is a perspective view illustrating a covering fastened to the sleeve of the handle assembly.

Referring to FIG. 5, a channeled covering 44 may be fastened to the sleeve 10 on the top by screws 46 to act as a stop for the transverse handhold portion 21 of the handle bar 20 as the handle bar 20 is collapsed. Of course, the covering 44 has a hole 45 to accommodate moving the handle bar 20 in and out.

Figure 6:
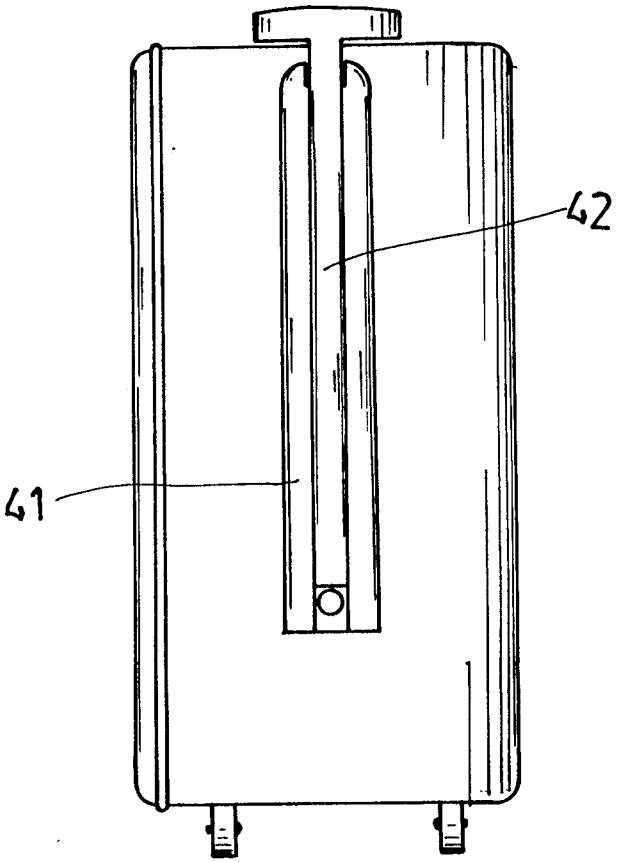
FIG. 6 is an end view illustrating an alternate form of the handle assembly.

Referring to FIG. 6, therein illustrated is an alternate form of the handle assembly. In this alternate form, the handle assembly is simply comprised of a channel plate 41 fastened to one lateral side wall of the shell of the travel bag, and an elongated handle bar 42 movably inserted into the channel plate 41. Similar to the handle assembly of FIG. 1, the channel plate 41 has two opposite stub rods respectively fitted into two opposite side grooves on the elongated handle bar 42.

Figure 8:
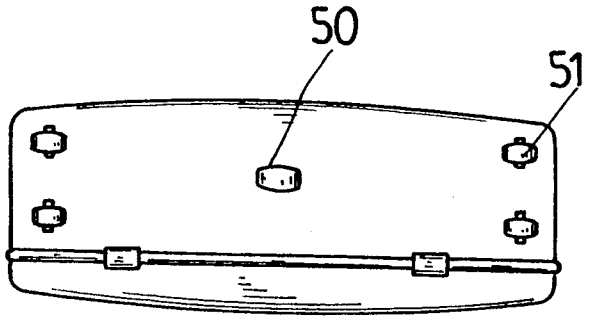
FIG. 8 is a bottom view of the travel bag showing the positions of the fixed castor and the swivel castors.
Figure 7:
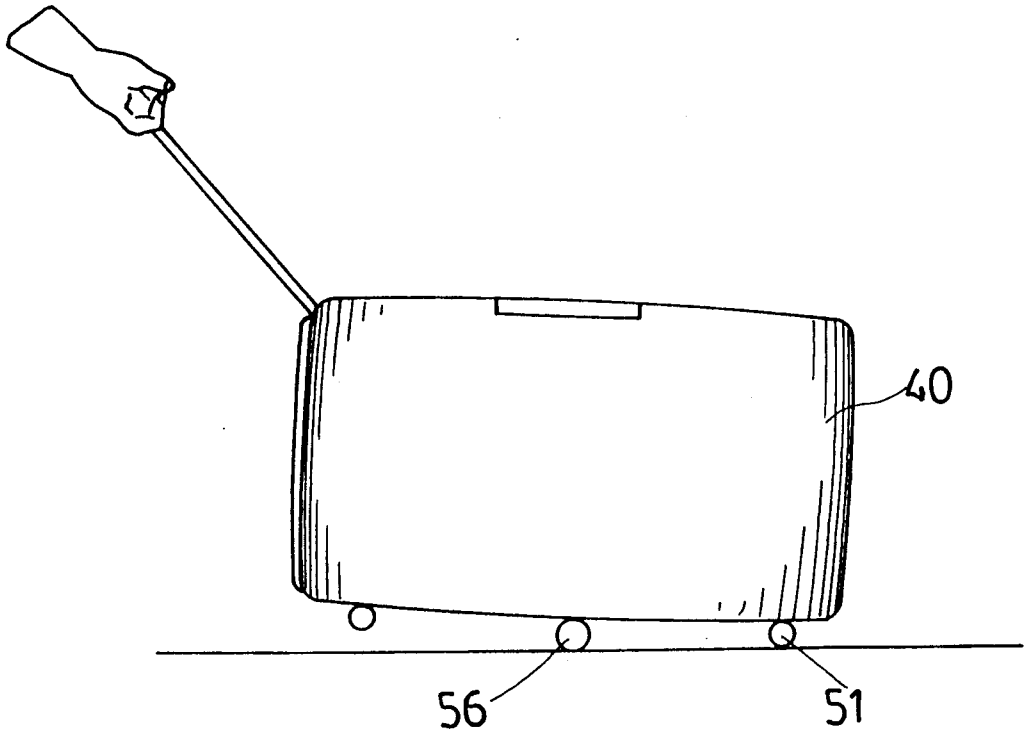
FIG. 7 is a side plan view showing the luggage supported on the ground by the fixed castor and the front swivel castors.
Figure 9:
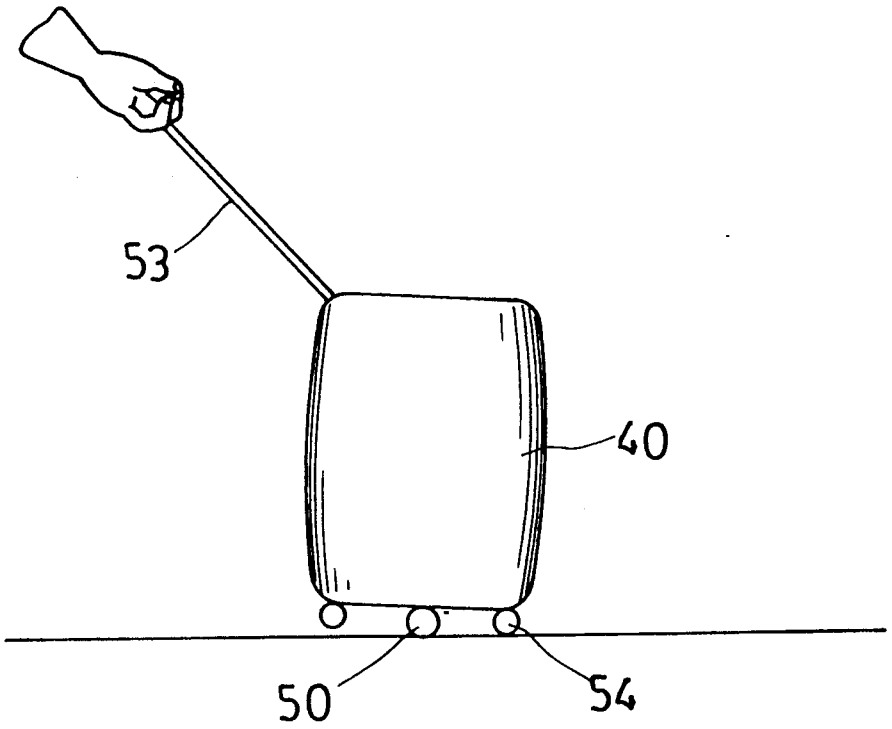
FIG. 9 is a side view illustrating the handle assembly fastened to the travel bag on one large face thereof and carried with the hand to move the luggage sideways.

Referring to FIGS. 7, 8, 9, the travel bag 40 has a convexly cured bottom edge with a fixed castor 50 in the middle and two opposite pairs of swivel castors 51 adjacent two opposite ends. As the travel bag is moved, only the fixed castor 50 and the two swivel castors 51 on the rear end contact the ground to support the travel bag 40. This arrangement enables the user to pull the travel bag 40 with less labor and permits the bag 40 to be turned in another direction conveniently and stably. In FIG. 9, the handle assembly 53 is fastened to one large side face panel of the travel bag 40 to permit the travel bag 40 to be moved sideways.

I claim:

1. A travel bag for enclosing a travelers belongs comprising:

a) a case having a generally convexly curved bottom and at least one side;

b) a wheel non-pivotally attached to a middle portion of the convexly curved bottom, the wheel being rotatable about an axis of rotation;

c) two pairs of pivoting castors attached to the bottom, the two pairs being located on opposite sides of the axis of rotation; and, d) an adjustable handle assembly attached to the at least one side, the handle assembly comprising:

i) an elongated handle bar having a handhold portion;

ii) a sleeve affixed to the at least one side, the sleeve including means defining an elongated channel with an open end adapted to slidably receive the elongated handle bar therein such that the elongated handle bar is movable between a retracted position and an extended position;

iii) pivot means operatively associated with the elongated handle bar enabling the handle bar to be angularly moved about a pivot axis with respect to the sleeve when in its extended position, the pivot axis extending generally parallel to the axis of rotation; and, iv) locking means operatively associated with the elongated handle bar and the sleeve to releasably lock the handle bar at a desired angular orientation with respect to the sleeve when the handle bar is in its extended position, wherein the locking means comprises: a plurality of teeth formed on an end of the elongated handle bar and, a projecting block extending from the sleeve and defining an edge portion adapted to engage at least one of the teeth formed on the elongated handle bar.

2. The travel bag of claim 1 wherein the edge portion is curved.

3. The bag of claim 1 wherein the projecting block is movable to a position such that the edge portion is out of engagement with the teeth to enable the angular position of the elongated handle bar to be adjusted.

4. The travel bag of claim 1 further comprising an auxiliary handle attached to the sleeve.

5. The travel bag of claim 4 further comprising pivot attachment means to pivotally attach the auxiliary handle to the sleeve such that it is movable between extended and retracted positions.

6. The travel bag of claim 5 further comprising spring biasing means operatively associated with the auxiliary handle to bias the auxiliary handle toward its retracted position.

7. The travel bag of claim 6 wherein the spring biasing means comprises a torsion spring.

8. A travel bag for enclosing a travelers belongs comprising:

a) a case having a generally convexly curved bottom and at least one side;

b) a wheel non-pivotally attached to a middle portion of the convexly curved bottom, the wheel being rotatable about an axis of rotation;

c) two pairs of pivoting castors attached to the bottom, the two pairs being located on opposite sides of the axis of rotation; and, d) an adjustable handle assembly attached to the at least one side, the handle assembly comprising:

i) an elongated handle bar having a handhold portion;

ii) a sleeve affixed to the at least one side, the sleeve including means defining an elongated channel with an open end adapted to slidably receive the elongated handle bar therein such that the elongated handle bar is movable between a retracted position and an extended position;

iii) pivot means operatively associated with the elongated handle bar enabling the handle bar to be angularly moved about a pivot axis with respect to the sleeve when in its extended position, the pivot axis extending generally parallel to the axis of rotation;

iv) locking means operatively associated with the elongated handle bar and the sleeve to releasably lock the handle bar at a desired angular orientation with respect to the sleeve; and, v) an auxiliary handle attached to the sleeve.

9. The travel bag of claim 8 further comprising pivot attachment means to pivotally attach the auxiliary handle to the sleeve such that it is movable between extended and retracted positions.

10. The travel bag of claim 9 further comprising spring biasing means operatively associated with the auxiliary handle to bias the auxiliary handle toward its retracted position.

11. The travel bag of claim 10 wherein the spring biasing means comprises a torsion spring.

* * * * *